US005478079A

United States Patent [19]

Liberatore et al.

[11] Patent Number: 5,478,079

[45] Date of Patent: Dec. 26, 1995

[54] GOLF TRAINING APPARATUS

[76] Inventors: Anthony Liberatore; Sharyn S. Liberatore, both of P.O. Box 16200-374, Mesa, Ariz. 85211

[21] Appl. No.: 375,822

[22] Filed: Jan. 20, 1995

[51] Int. Cl.[6] ..... A63B 69/36

[52] U.S. Cl. ..... 273/186.2; 273/191 B

[58] Field of Search ..... 273/191 B, 186.2

[56] References Cited

U.S. PATENT DOCUMENTS

| | | | |
|---|---|---|---|
| 3,400,933 | 9/1968 | Heiser | 273/186.2 |
| 4,034,991 | 7/1977 | Oppenheimer | 273/186 A |
| 4,449,708 | 5/1984 | Humphrey | 273/186.2 |
| 4,653,757 | 3/1987 | Wilkinson | 273/191 R |
| 4,949,974 | 8/1990 | Bellagamba | 273/186 R |
| 5,139,264 | 8/1992 | Wootten | 273/191 R |
| 5,265,876 | 11/1993 | Moon | 273/186.2 |

*Primary Examiner*—William H. Grieb

[57] ABSTRACT

Golf swing training apparatus includes a mounting bracket that holds a horizontal slide bar, mated to a swivel lateral traveler that attaches to one end of a coiled spring, and the other end to a flexible radius arm that is adjustable in length. The other end of the flexible arm is temporarily attached to the golf club during the practice session. Practice using the apparatus assists the golfer in developing a uniform swing plane, consistent clubhead control and conditioned muscle swing techniques that can improve his/her golf performance.

4 Claims, 4 Drawing Sheets

GOLF TRAINING APPARATUS

TECHNICAL FIELD

This invention provides a simple apparatus that when properly utilized in practice can assist the golfer to develop a proper and effective golf swing.

BACKGROUND ART

An effective golf swing requires that the golfer take back the club in a consistent, customized swing plane arc over the right shoulder, pivot the body, shift the body, arms and hips forward as the club returns on the downward arc toward the original starting position behind the ball, strikes the ball and then continues on a follow through arc, pivoting the body while the club continues on the arc until it stops over the left shoulder (reversed for left handed players). Consistent and effective performance requires developing a predictable swing with a repeatable pendulum motion, along an instinctive swing plane with the golfer in constant control of the club during the swing. Errors occur in striking the ball when the ascending or descending swing plane is altered and when the club does not return properly to the originating position behind the ball. If an improper swing is used, practiced and conditioned as normal, the golfer will make inconsistent and unpredictable contact with the ball resulting in erratic performance.

A number of golf swing training apparatus have been developed and patented that attach to the club and encourage or force the golfer to swing along a predetermined arc depending upon the length, position and method of attachment of the "radius arm" of the swing training apparatus. Other golf swing apparatus are disclosed in U.S. Pat. Nos. 5,265,876, 5,139,264, 4,949,974 and 4,653,757 which incorporate a rigid rod or piece of tubing as the "radius arm" of the apparatus that guides the golf club along a planar arc in the ascending and descending swing mode. Other golf swing training apparatus are identified as The Dream Swing Machine, SwingTech, The Swinging, Perfect Swing and Dunaway Way and The Coach, encourage proper swing using a pendulum motion along a proper swing plane or arc. The device also encourages swings that are consistent and repetitive.

Each of these prior known apparatus enable the golfer to practice "some form" of planar swings, but there are limitations in the design of those apparatus that prevent the golfer from practicing an elliptical swing. All previous apparatus with "rigid radius arms" force the golfer to swing the club along predetermined swing plane, and semi-circular (rather than elliptical arc). Such apparatus create a teaching crutch that eliminates the conscious involvement of the golfer in perfecting his/her swing plane. In addition, such attachment rods control the path of the club, thus diminish the value of the practice session and create a reliance on the apparatus which will be detrimental when playing the game without the benefit of the training crutch. These known devices also require complex and bulky frameworks, large open areas for the practice session and are difficult to leave set up ready for practice to use at any time, they are also exceedingly expensive relative to the benefits derived by the golfer.

SUMMARY OF INVENTION

The golf swing training apparatus and mounting hardware weighs less than one pound, is extremely portable and cost effective in providing training benefits relative to the cost of the device. The user installs the mounting bracket to a wall, tree or other indoor/outdoor vertical surface that will withstand the pull from the swing force of the club.

Definitions:

Flexible Radius Arm—Flexible cable or other material that reaches from the mounting bracket down to the golf club head and is adjustable in length.

Horizontal Slide Bar—Steel rod, bolt or other material that is attached to the mounting bracket, horizontal to ground.

Swivel Lateral Traveler—Pulley or sliding device that travels along the horizontal slide bar during the swing and allows a 360 degree rotation, as well as a up-down and side-to-side motion of the flexible radius arm.

Attached to the mounting bracket is a group of components consisting of a horizontal slide bar mated to a swivel lateral traveler, that holds one end of a coiled spring attached to one end of the flexible radius arm (or similar components) that allows the whole device to slide a few inches during each practice swing. An auditory click from the swivel lateral traveler provides the user with a way to measure tempo and timing for the swing. The combination of the traveler and "flexible radius arm" requires that the golfer maintain tension on the flexible radius arm (cable), swing the club in a pendulum motion along a planar arc and complete an elliptical swing. This training apparatus requires that the user have a conscious and physical involvement in creating the proper swing by maintaining "constant tension" on the flexible radius arm during the ascending and descending swing. Any release of the tension throughout the swing allows the flexible radius arm to buckle, and provides immediate feedback to the user that a proper arc and/or swing plane has been broken. Such "constant tension" swings also develops the proper golf swing muscles and conditions mental control (muscle memory) over the body movements that produce a proper elliptical golf swing.

DESCRIPTION OF PREFERRED EMBODIMENTS

Figure 1:
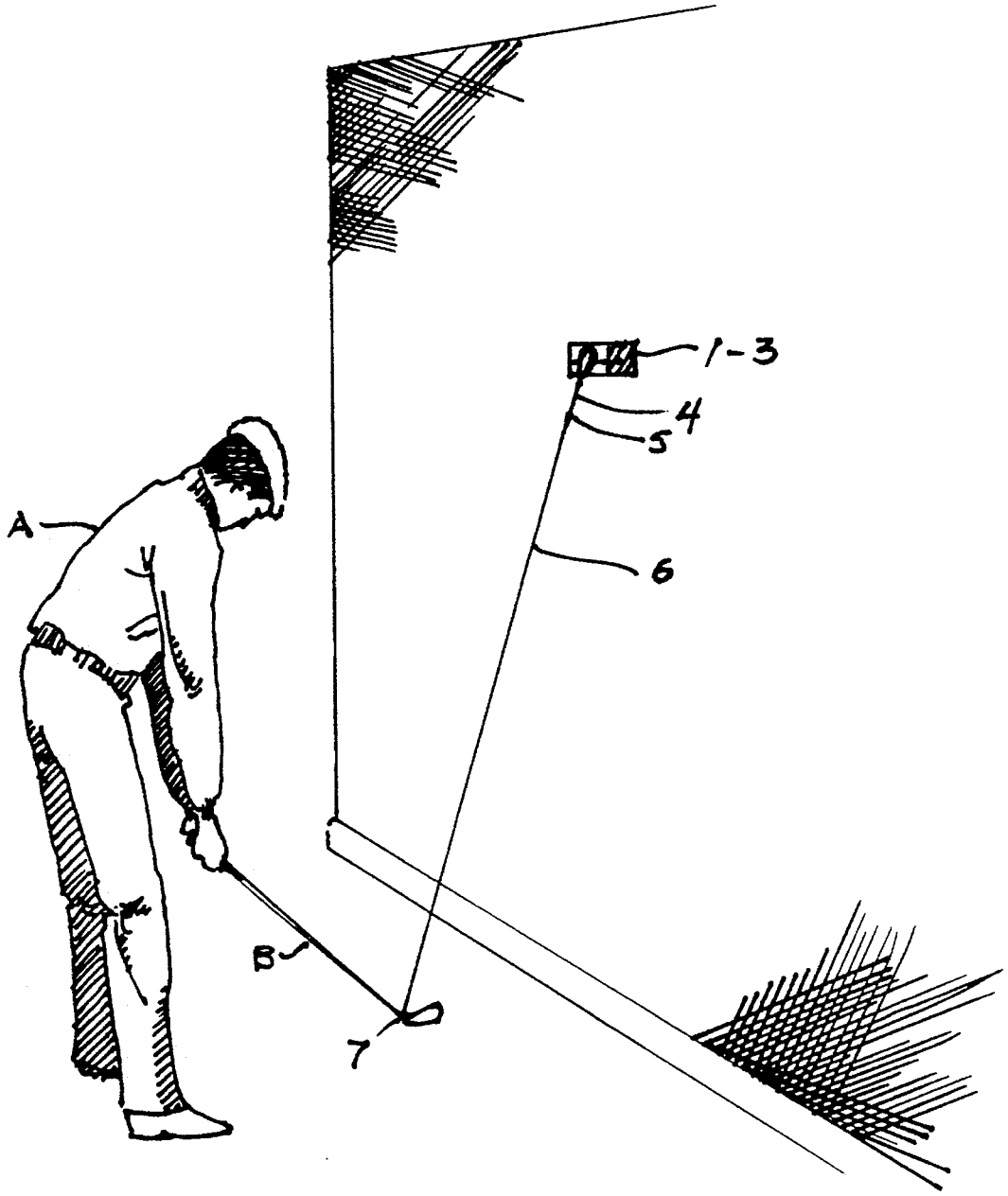
FIG. 1 Golfer at address with apparatus
Figure 2:
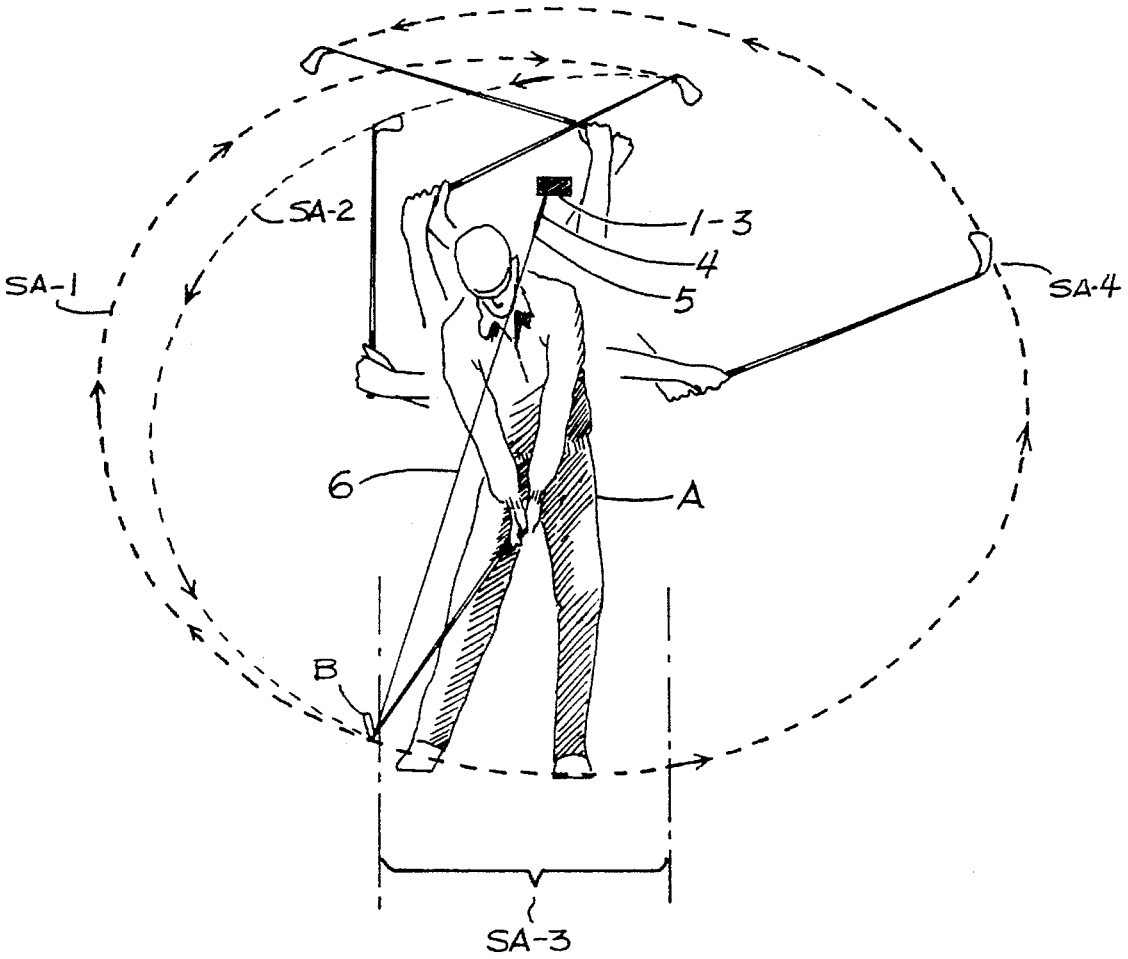
FIG. 2 Golfer's swing arcs and apparatus overview

Referring to FIGS. 1 & 2, a golfer is shown using the invented golf swing training apparatus for which patent protection is sought. The human figure, (A) represents a golfer, that is using the device for practicing and improving the user's swing. Item (B) is the golf club, to which the training apparatus attaches during the practice session, as detailed later. The circular broken lines represent the swing arcs that the golfer causes the golf club to take in the ascending (SA-1) and descending (SA-2), impact sweep zone (SA-3) and follow through (SA-4) portions of the swing.

Figure 3:
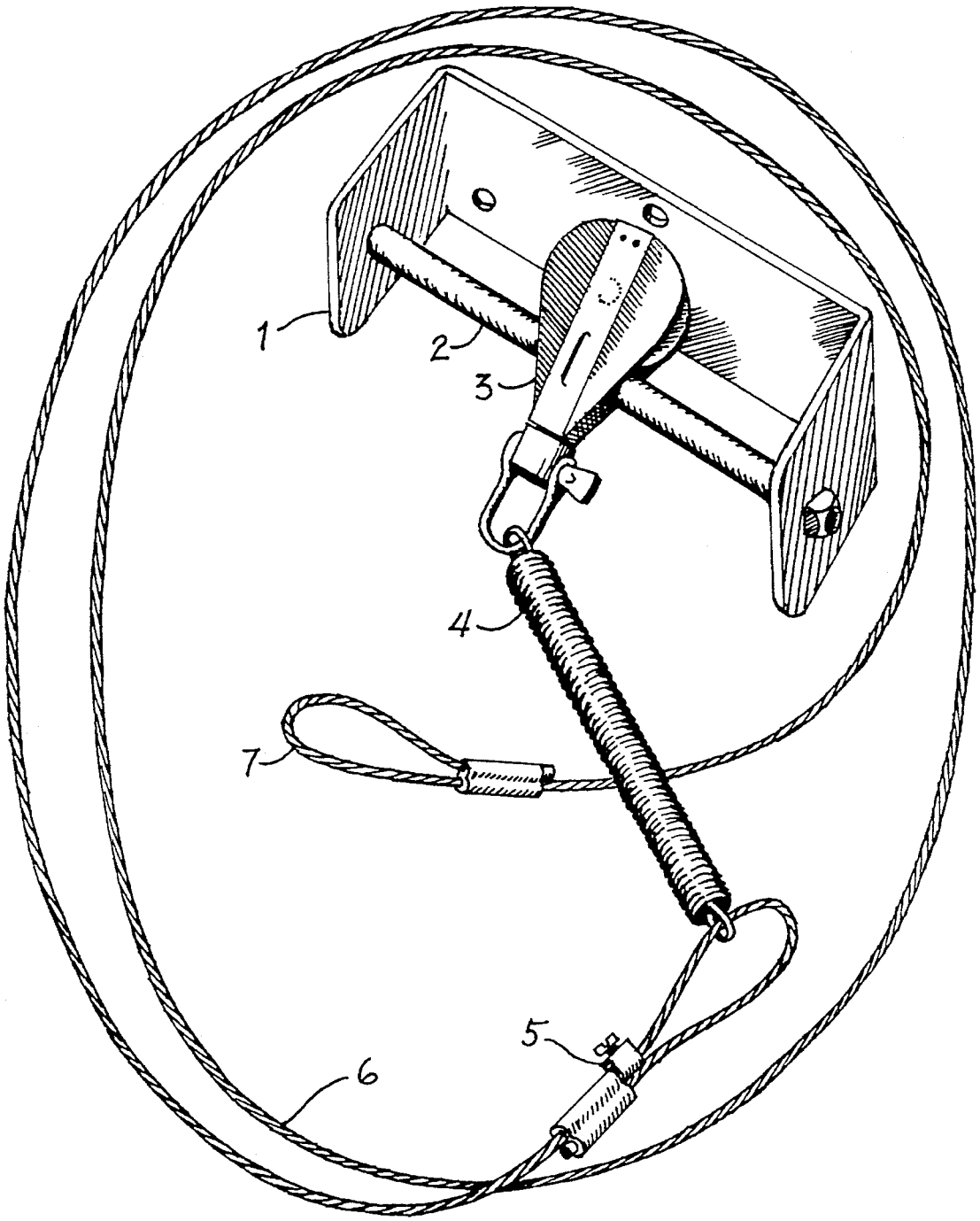
FIG. 3 Product parts

FIG. 3 shows the components of the training apparatus are identified as items, (1) the mounting bracket, (2) the horizontal slide bar, (3) the swivel lateral traveler (pulley or sliding device) that attaches to the (4) coiled extension spring which is attached to one end of the (6) "flexible radius arm (adjustable)" that extends from the swivel lateral traveler down to the golf clubhead, [(5) break or clamp device for adjusting the length], and (7) for the slide loop connection of the cable that attaches to the hosel of the club.

A golfer uses the training apparatus by attaching the mounting bracket (1) using screws or other mounting hardware to a interior or exterior, wall, post, or other vertical member that allows the bracket to be positioned directly in front of and slightly above the head of the user, and in an area allowing a full golf swing as shown in the SA-1, 2, and 4 arcs.

Figure 4:
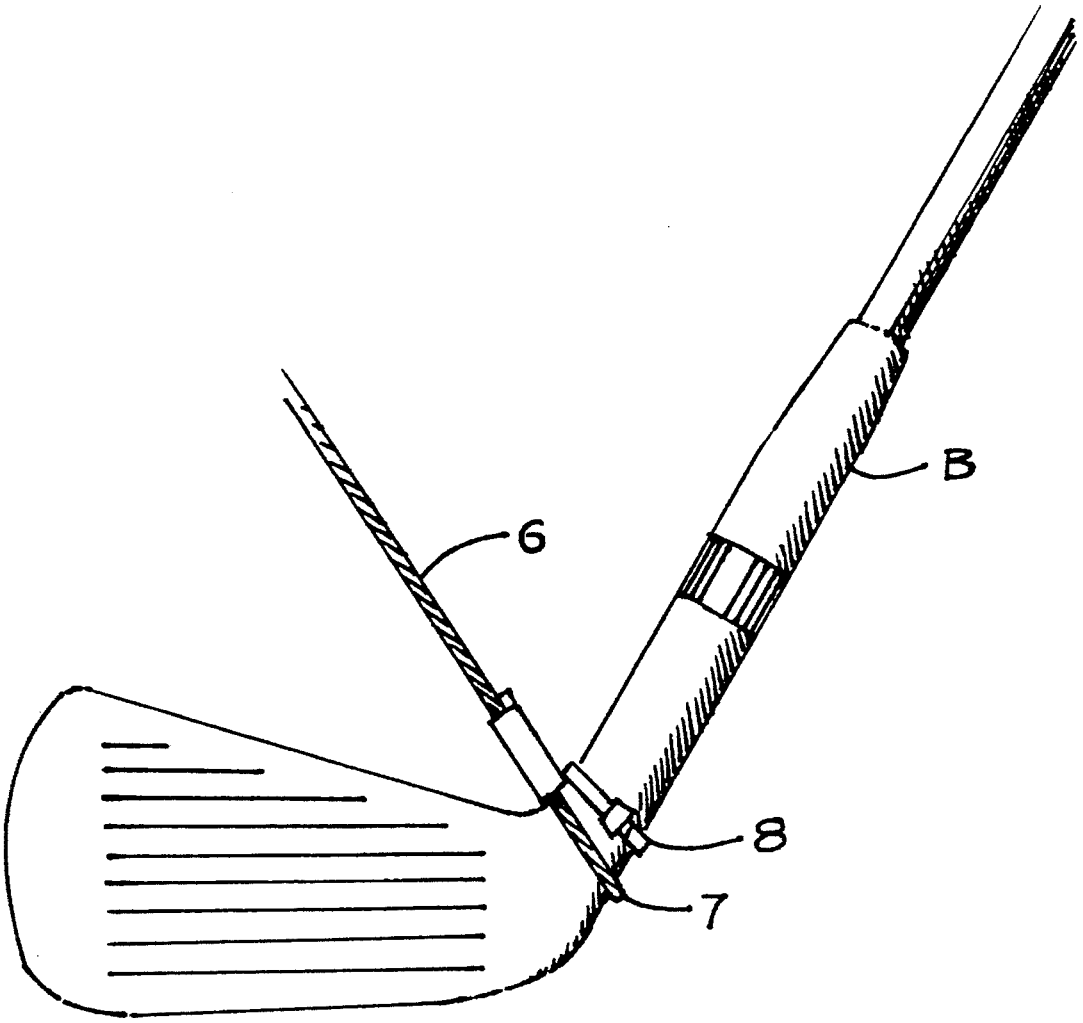
FIG. 4 Attaching configuration to golf clubs

The end of the cable is then attached to the club (see FIG. 4) by expanding the loop (7) in the end of the cable (6) (or other coupling device) and placing it over the clubhead portion of the club (B). At the clubhead end the cable is doubled through a ferrule to allow a slip loop to be formed that when pulled tight, squeezes the hosel (connection between the clubhead and the shaft) of the clubhead. In the event that the hosel of the club is not grooved or tapered at the connection point, then a collar band (8) can be attached to the hosel as a collar to prevent the slippage of the cable down the shaft during the swing.

Once the training apparatus is mounted to a wall, post, tree, etc. and the cable is attached to the club, the golfer is ready to begin the training session. The operation of the apparatus is described as follows:

1. The golfer will address a real or imaginary ball position during the practice session by placing the golf clubhead directly behind the ball position. As the clubhead is pulled back during the ascending part of the swing (SA-1) the club follows a take-away arc that is restricted by the "flexible radius arm". If the swing is not in a uniform radius or along a consistent swing plane, the flexible radius arm will buckle alerting the golfer to the error in his/her swing motion. At the top of the swing, the swivel lateral traveler will slide to one extreme end of the horizontal slide bar causing the first of three audible clicks during a normal swing. If needed the coiled extension spring will stretch to allow the club to go back to the position that the golfer desires to be rat the top of his/her backswing.

As the golf club reaches the top of the backswing, the golfer then shifts his/her hips, pulling the elbow into the side and starts the descending (downswing) (SA-2) portion of he swing with the arms. The stretched extension spring, flexible radius arm, and swivel lateral traveler allow the club to travel back along a shorter descending arc (SA-2) toward the original ball position. If the golfer causes the club to diverge from the proper arc or swing plane, the club will go slack (buckle) alerting the golfer to the error of his/her swing.

When starting the descending portion of the swing (SA-2) the extension spring will recoil to its natural state assisting and boosting the golfer to start the downward swing, and the swivel lateral traveler will slide to the other end of the slide bar causing the second of the three audible clicks as the club approaches the ball (SA-3) and the third click is heard during the follow-through portion of the swing (SA-4). These clicks (like a metronome) during repetitive practice swings give the golfer some auditory feedback to develop a proper tempo for a controlled backswing and downswing.

The design of this golf swing training apparatus is ideal for golf swing and muscle memory development because it requires that the golfer maintain control of the clubhead along a proper arc and swing plane. Affixing the flexible radius arm to a swivel lateral traveler that moves laterally on a slide bar (rather than one fixed point) allows it to rotate, move up and down and swivel freely during the swing. This freedom of movement of the flexible radius arm allows the golfer to create an elliptical swing as shown in FIG. 1, rather than a true circular path. Adjusting the length of the flexible radius arm will allow the apparatus to be used by any size golfer, with any type of swing.

In order to produce the proper downward swing the golfer must shift the body, weight, and pull the right or left elbow into the side which shortens the downswing (SA-2 from SA-1), and the follow-through portion of the swing is elongated, creating an elliptical swing pattern. This elliptical swing pattern is important because it allows the club to travel horizontally with the ground for a longer period of time at the bottom of the swing arc (impact sweep zone SA-3) giving the golfer the increased opportunity for solid contact with the ball. Were the device to have a rigid radius arm (as in previous patented devices) the arcs would be restricted to true circular shape. If the device did not incorporate a laterally traveling pulley or roller device, the swing arcs could not shift during the swing allowing the elliptical swing pattern, as well as the extended impact sweep zone at the bottom of the swing. This elliptical swing pattern, and extended impact sweep zone is highly desirable in a golf swing.

By changing the golfer's club and stance position, the golf swing training apparatus allows for the practice of the different swings that are needed for driving (tee shots), fairway woods & irons, hook and slice stances, bunker shots and putting on greens. All of these strokes require swinging a club in a pendulum motion, along a predictable arc and swing plane, which requires a golfer to control the clubhead. Thus, this practice apparatus enhances the ability to swing with consistency on all of the types of strokes required for various clubs during an actual round of golf.

What is claimed in this patent application is detailed as follows:

1. A golf swing training apparatus comprising;

a mounting bracket for vertical support, a horizontal slide bar which is part of the mounting bracket, a swivel lateral traveler mated to the horizontal slide bar, a coiled extension spring attached at one end to said lateral traveler, a flexible radius arm attached to the other end of said extension spring, adjustment means of adjusting the length of said flexible radius arm, coupling means for connecting the flexible radius arm to the hosel portion of a golf club, and adjustable means positioned on the golf club shaft near the club head that prevent the coupling means from sliding down the shaft during a practice session, whereby, when all means are properly installed, mounted and attached to a golf club, allow and actively encourage the golfer to swing the club in a more effective way after repetitive practice sessions.

2. Golf swing training apparatus as set forth in claim 1 including;

means for attaching said mounting bracket to said vertical support so that it can be removed and reinstalled.

3. Golf swing training apparatus as set forth in claim 1, wherein said flexible radius arm is adjustable in length and made of material that will withstand the pull tension of a golf club during a swing, that links the hosel of the golf club to the mounting bracket attached to the vertical support in a way that allows flexibility of movement.

4. Golf swing training apparatus as set forth in claim 1, wherein said adjustment means allows said radius arm to be lengthened or shortened to accommodate any height of golfer, and any type of swing plane.

* * * * *